United States Patent [19]

Lagassee

[11] Patent Number: 4,961,291

[45] Date of Patent: Oct. 9, 1990

[54] GLASS HOLDER TOOL

[76] Inventor: Richard L. Lagassee, 1625 W. Territorial Rd., Battle Creek, Mich. 49015

[21] Appl. No.: 389,127

[22] Filed: Aug. 3, 1989

[51] Int. Cl.[5] ..... B24B 41/06

[52] U.S. Cl. ..... 51/217 P; 51/218 P; 81/418

[58] Field of Search ..... 81/418, 420, 488; 51/217 P, 218 P, 102

[56] References Cited

U.S. PATENT DOCUMENTS

| | | | |
|---|---|---|---|
| 1,445,908 | 2/1923 | Perkins . | |
| 1,612,474 | 12/1926 | Strain | 81/418 |
| 1,686,640 | 10/1928 | Pierce | 81/418 X |
| 3,088,252 | 5/1963 | Schmidt | 51/218 P |
| 3,263,535 | 8/1966 | Zurcher | 81/418 X |
| 3,991,635 | 11/1976 | Marone | 81/420 |
| 4,315,447 | 2/1982 | Tartaglia . | |
| 4,461,193 | 7/1984 | Gruber et al. | 87/420 |

*Primary Examiner*—James G. Smith

*Attorney, Agent, or Firm*—Flynn, Thiel, Boutell & Tanis

[57] ABSTRACT

A glass holder tool includes first and second elongate lever arms respectively including first and second handle portions at one end thereof, first and second jaw portions at the other end thereof, and central portions extending respectively between the handle portions and jaw portions. The lever arms are disposed in a crossing arrangement and pivoted at their central portions. The handle portions are disposed on a first side of the pivot and the jaw portions are disposed on a second side thereof opposite the first side. The lever arms are pivotable such that the jaw portions move relatively toward and away from each other in response to relative movement of the handle portions respectively toward and away from each other. Each jaw portion has a gripping plate attached to a free end thereof. One gripping plate extends from the first jaw portion at a first angle relative thereto such that, when the gripping plates are separated by a first predetermined distance, the second handle portion is offset from the one gripping plate toward the other gripping plate by a second predetermined distance.

14 Claims, 1 Drawing Sheet

GLASS HOLDER TOOL

FIELD OF THE INVENTION

This invention relates to a tool for use in holding small pieces of decorative glass against an abrasive member which is rotatably supported with respect to a generally planar work surface and, more particularly, to a glass holding tool which facilitates a steady and uniform holding of a piece of glass against such an abrasive member.

BACKGROUND OF THE INVENTION

Conventional grinding tools for shaping small pieces of glass usually include a grinding wheel supported rotatably about a fixed axis of rotation, and a table which surrounds the peripheral surface of the grinding wheel to form a planar work surface which is generally perpendicular to the rotational axis of the wheel. Flat, substantially platelike pieces of glass are then placed flat on the table and fed perpendicularly to the grinding wheel while held flat against the planar work surface. In this manner, the edge of the flat piece of glass can be ground to an angle relative to the flat surfaces of the piece of glass, which angle is substantially equal to the angle between the peripheral surface of the grinding wheel and the planar work surface. If the operator uses his or her hands to guide the piece of glass against the grinding wheel, there is a significant danger of cutting the hands, due to the sharp edges of the glass and the somewhat jerky nature of the frictional engagement of the glass and the rotating grinding wheel. Conventional holding pliers may be used to hold the piece of glass, but do not provide any reliable means for the operator to firmly and steadily hold the piece of glass generally parallel to the work surface of the table and against the grinding wheel for the length of time necessary to form a desired edge as can be formed by holding the piece of glass flat against the table while grinding the edge. U.S. Pat. Nos. 1 445 908, 4 315 447, and 4 461 193 disclose examples of such conventional holding pliers. Thus, it is desirable to provide a tool which allows the operator to easily, safely and steadily hold the piece of glass generally parallel to the work surface and firmly against the grinding wheel for a sufficient length of time to form the desired edges.

Accordingly, an object of the present invention is to provide a glass holder tool with which a piece of glass can be steadily and uniformly fed perpendicularly toward a grinding wheel while being held generally parallel to the work table surface.

It is a further object of the present invention to provide a glass holder tool, as aforesaid, which an operator can easily and comfortably manipulate.

It is a further object of the present invention to provide a glass holder tool, as aforesaid, which provides improved safety for the operator.

It is a further object of the present invention to provide a glass holder tool, as aforesaid, which is simple and inexpensive to manufacture, and which is durable and easily maintainable.

SUMMARY OF THE INVENTION

The objects and purposes of the present invention are met by providing first and second elongate lever arms respectively including first and second handle portions at one end thereof, first and second jaw portions at the other end thereof, and central portions extending respectively between the handle portions and jaw portions. The lever arms are disposed in a crossing arrangement and pivoted at their central portions. The handle portions are disposed on a first side of the pivot and the jaw portions are disposed on a second side thereof opposite the first side. The lever arms are pivotable such that the jaw portions move relatively toward and away from each other in response to relative movement of the haddle portions respectively toward and away from each other. Each jaw portion has a gripping plate attached to a free end thereof. One gripping plate extends from the first jaw portion at a first angle relative thereto such that, when the gripping plates are separated by a first predetermined distance, the second handle portion is offset from the one gripping plate and a flat work surface of a grinding machine on which the one gripping plate is fully engaged, toward the other gripping plate by a second predetermined distance. The other gripping plate extends from the second jaw portion at a second angle relative theretosuch that the gripping plates are substantially parallel to each other when they are separated by the first predetermined distance.

BRIEF DESCRIPTION OF THE DRAWINGS

An exemplary embodiment of the invention will be described in detail hereinafter in connection with the drawings, in which.

DETAILED DESCRIPTION

Figure 2:
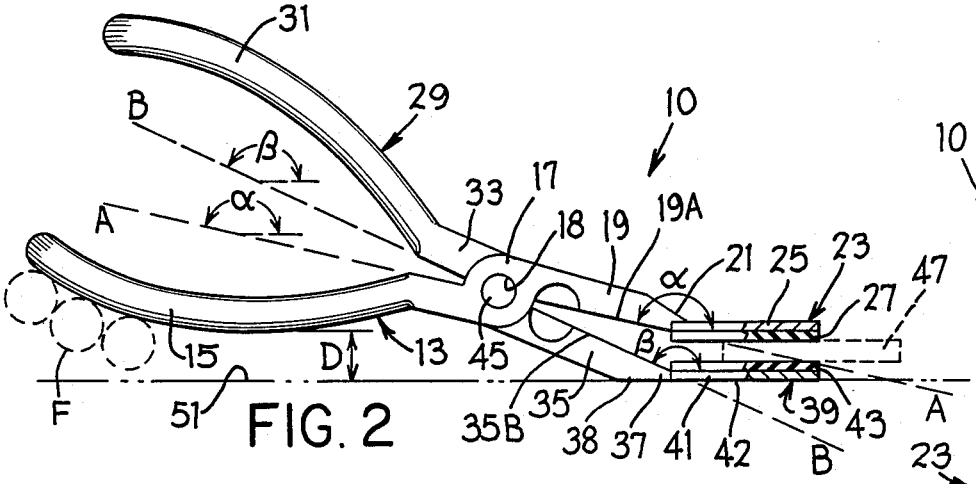
FIG. 2 is a side elevation of the inventive glass holder tool.
Figure 4:
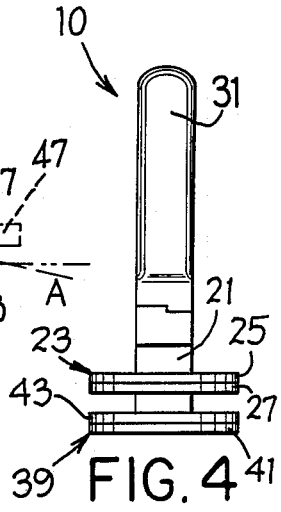
FIG. 4 is an end view of the tool shown in FIG. 2.
Figure 3:
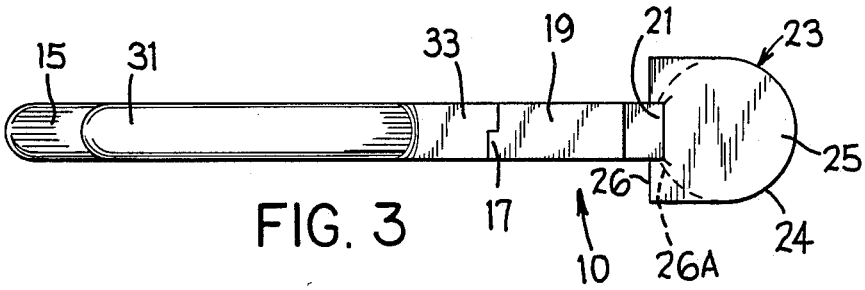
FIG. 3 is a top view of the tool shown in FIG. 2.

Referring to FIG. 2, the inventive glass holder tool 10 includes an elongate lever arm 13 having a curved handle portion 15 at one end thereof, a straight jaw portion 19 at the other end thereof, and a central portion 17 which joins the handle portion 15 and jaw portion 19. The central portion 17 has a circular hole 18 formed therethrough. The curved handle portion 15 and the straight jaw portion 19 are laterally offset from each other such that the central portion 17 which joins them has an enlarged lateral dimension. The jaw portion 19 has an edge 19A which faces laterally toward the handle portion 15 and lies on an axis A which passes through the center of the circular hole 18 of the central portion 17. As the handle portion 15 extends from the central portion 17 generally in the direction of the axis A, it gradually curves so as to extend first laterally further away from the jaw portion 19 and then laterally closer thereto. The jaw portion 19 extends from the central portion 17 and tapers to a free end 21. A gripping plate 23 is fixedly and non-movably secured at a peripheral edge thereof to the free end 21 of the jaw portion 19. As shown in FIGS. 2 and 3, the gripping plate 23 is a laminate structure including a base portion 25 secured to the free end 21 and a soft rubber gripping portion 27 secured to the base portion 25. The gripping plate 23 has a generally flat, planar overall structure. Referring to FIG. 3, the peripheral edge of the gripping plate 23 includes a semi-circular edge portion 24 joined with a semi-rectangular edge portion 26. The edge portion 26 is attached to the free end 21 of the jaw portion 19. Alternately, the plate 23 may have a circular peripheral edge as shown by the broken line 26A in FIG. 3. As shown in FIG. 2, the gripping plate 23 extends from the free end 21 of the jaw portion 19 so as to form an obtuse angle a relative to the axis A of the lever arm 13.

The glass tool holder 10 also includes a second lever arm 29 including a handle portion 31, a central portion 33 and a jaw portion 35 having a free end 37. The lever arm 29 is preferably identical to the lever arm 13 described above, and will therefore not be completely described in detail. A flat support surface 38 is defined on the jaw portion 35 as it tapers toward its free end 37. A gripping plate 39 including a base portion 41 and a soft rubber gripping portion 43 is attached to the free end 37 of the jaw portion 35. The gripping plate 39 is identical to the gripping plate 23 described above. The gripping portion 43 faces the gripping portion 27 to thereby provide generally opposed non-skid rubber gripping surfaces to engage a piece of glass 47 held between gripping plates 23 and 39. The gripping plates 23 and 39 preferably have a thickness less than or equal to ⅛ inch. The base portions 25 and 41 and the gripping portions 27 and 43 are preferably approximately 1/16 inch thick.

The jaw portion 35 includes an edge 35B which faces laterally toward the handle portion 31 and lies on an axis B which passes through the center of a circular hole (not shown) in the central portion 33 corresponding to the circular hole 18 in the central portion 17. The gripping plate 39 extends from the free end 37 such that it forms an obtuse angle $\beta$ relative to the axis B of the lever arm 29. The base portion 41 of the gripping plate 39 is attached to the jaw portion 35 such that a flat support surface 42 of the base portion 41, which support surface 42 is opposite the gripping portion 43, is contiguous and coplanar with the flat support surface 38 on the jaw portion 35.

The lever arms 13 and 29 with the gripping plates 23 and 39 respectively attached thereto are disposed in a crossing arrangement such that their central portions 17 and 33 overlap. The lever arms 13 and 29 are pivotally supported on a transverse pivot pin 45 extending through the hole 18 in the central portion 17 and a similar hole (not shown) in the central portion 33 which is aligned with the hole 18. The lever arms and attached gripping plates are thus pivotable relative to each other such that the jaw portions 19 and 35 and respectively attached gripping plates 23 and 39 are movable relatively toward and away from each other in response to relative movement of the handle portions 15 and 31 toward and away from each other, respectively. The arrangement is such that the gripping plates 23 and 39 are mutually abuttingly engagable.

Figure 1:
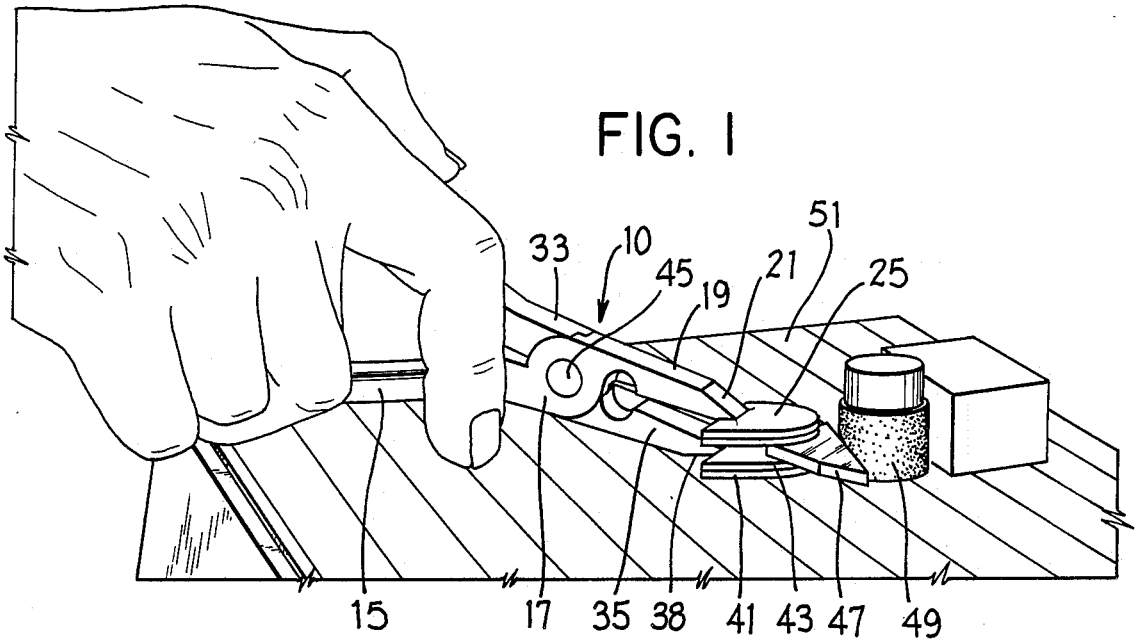
FIG. 1 is a pictorial view showing the inventive glass holder tool in use with a conventional grinding apparatus.

Referring to FIGS. 1 and 2, the glass holder tool 10 is used by placing the flat support surface 42 of the base portion 41 of the gripping plate 39 flat onto a flat working table 51 of a grinding apparatus, which table 51 extends, in this example, substantially perpendicularly from the periphery of a grinding wheel 49 rotatable about an axis of rotation that extends perpendicular to the plane of the flat working table 51. In this embodiment, the flat support surface 38 of the jaw portion 35 is coplanar with the support surface 42 and thus also seats securely on the table 51. The gripping plate 39 is attached to the free end 37 at the angle $\beta$ relative to the axis B of the lever arm 29 such that when a piece of glass 47 having a known thickness (for example, 9/64 inches) is held between the gripping plates 39 and 23, thereby separating the gripping plates 39 and 23 by a distance equal to the thickness of the piece of glass 47, the handle portion 15 of the lever arm 13 is far enough above the surface of the table 51 for the insertion of human fingers therebetween. That is, with the flat support surfaces 38 and 42 seated against the table 51, and with the piece of glass 47 gripped between the gripping plates 23 and 39, the handle portion 15 is, due to the construction of the tool 10, located at a distance D above the table 51 which is sufficient to allow finqers F of a hand holding the tool 10 to fit freely between the handle portion 15 and the table 51 (see FIG. 2). Thus, the handle portion 15 can be gripped with fingers F as shown in FIGS. 1 and 2 without the fingers touching the surface of the table 51. In the disclosed preferred embodiment, the angle $\beta$ is preferably about 155°.

Other embodiments of the tool 10 may be manufactured, each different embodiment being designed specifically for use with a specific thickness of glass and thus having a different value of $\beta$ in order to maintain the aforementioned clearance distance D between the fingers F and the table 51. Such an alternate embodiment might have a specific value of $\beta$ between, for example, 130 ° and 155°, according to the thickness of the glass with which it is to be used.

Once the angle $\beta$ has been determined, the angle a is determined such that the gripping plate 23 is substantially parallel to the gripping plate 39 when the gripping plates are spaced by an amount equal to the thickness of the piece of glass 47. Therefore, the gripping plates 23 and 39 are substantially parallel to each other when gripping the piece of glass 47 therebetween. Thus, referring to FIGS. 1 and 2, the glass 47 is supported parallel to the gripping plates, the support surface 42, and the surface of the table 51. With the support surface 42 resting securely against the table 51, the glass 47 can be maintained parallel to the table 51, and the plane thereof thus perpendicular to the axis of rotation of the grinding wheel 49, as it is steadily and uniformly fed to the grinding wheel 49 so as to form a desired edge. The glass 47 is held against motion parallel to the gripping plates by frictional engagement with the opposed non-skid rubber gripping portions 27 and 43.

Although the invention has been described in connection with its use in grinding pieces of glass, it will be understood that the inventive concept may be applied to similar processes involving machining and shaping a variety of sheet-like materials having a variety of thicknesses.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An apparatus for holding flat sheet-like objects against an abrasive wheel which is rotatably supported with respect to a planar work surface, comprising:

first and second elongate lever arms, said lever arms respectively including first and second handle portions at one end thereof, first and second jaw portions at the other end thereof, and central portions extending respectively between said handle portions and said jaw portions, said lever arms being disposed in a crossing arrangement such that said central portions overlap, said lever arms being pivotally connected at said overlapped central portions, said handle portions being disposed on a first side of said overlapped central portions and said jaw portions being disposed on a second side of said overlapped central portions opposite said first side, said lever arms being pivotable such that said jaw portions move relatively toward and away from each other in response to relative movement of said handle portions respectively toward and away from each other, each said jaw portion having a free end spaced from said overlapped central portions; and first and second gripping plates each fixedly and nonmovably attached to respective said free ends of said first and second jaw portions, said first and second gripping plates including first and second gripping surfaces, at least one of said first gripping plate and said first jaw portion having means defining a substantially flat support surface facing oppositely from said first gripping surface and adapted for engagement against the planar work surface, said gripping plates surfaces face each other, said gripping plates being relatively movable toward and away from each other along with said jaw portions, said first gripping plate extending away from said first jaw portion at a first fixed angle relative thereto such that, when said gripping plates are separated by a first predetermined distance, said second handle portion is offset from said support surface toward said second gripping plate by a second predetermined distance, said second gripping plate extending away from said second jaw portion at a second fixed angle relative thereto such that said gripping plates are substantially parallel to each other when they are separated by said first predetermined distance.

2. The apparatus according to claim 1, wherein said gripping plates are adapted to grip uniformly thick glass sheets therebetween, wherein said gripping surfaces are made from a soft elastic material, and wherein said gripping plates have peripheral edges which have a semi-circular shape.

3. The apparatus according to claim 2, wherein said first and second angles are obtuse, wherein said first predetermined distance is approximately 9/64 inches, and wherein said second predetermined distance is, at a minimum, approximately equal to the diameter of a human finger.

4. The apparatus according to claim 1, wherein said gripping plates each include a plate-like base portion and a plate-like gripping portion, said base portions being fixedly attached to respective said free ends of said jaw portions, said gripping portions being attached to said base portions and defining said gripping surfaces, said gripping portions being made from a rubber material, each of said gripping plates having a peripheral edge which has a semi-circular shape.

5. The apparatus according to claim 4, wherein said first jaw portion includes said means defining said support surface adjacent said free end thereof.

6. The apparatus according to claim 5, wherein said base portions and said gripping portions have a thickness of approximately 1/16 inch, and wherein said gripping plates have a total thickness which is one of less than 1/8 inch and equal to 1/8 inch.

7. The apparatus according to claim 6, wherein said first and second angles are obtuse, wherein said first predetermined distance is approximately 9/64 inches, and wherein said second predetermined distance is, at a minimum, approximately equal to the diameter of a human finger.

8. The apparatus according to claim 7, wherein said first angle is within a range of 130°–155°.

9. The apparatus according to claim 8, wherein said first angle is equal to 155°.

10. The apparatus according to claim 4, wherein said first gripping plate includes said means defining said support surface on said base portion thereof.

11. The apparatus according to claim 1, wherein said first jaw portion and said first gripping plate both include respective said means defining said support surface, said support surfaces of said first jaw portion and said first gripping plate being substantially contiguous and coplanar.

12. In an apparatus for grinding a decorative glass plate, including a grinding wheel supported rotatably about an axis, and a substantially flat work table closely surrounding at least a portion of the periphery of the grinding wheel, the improvement comprising:

hand-held means adapted to seat flat on the work table for supporting the glass plate generally parallel to the work table while simultaneously feeding it steadily against the grinding wheel without contact between the hand and the table, said hand-held means including first and second elongate lever arms, said lever arms respectively including first and second handle portions at one end thereof, first and second jaw portions at the other end thereof, and central portions extending respectively between said handle portions and said jaw portions, said lever arms being disposed in a crossing arrangement such that said central portions overlap, said lever arms being pivotally connected at said overlapped central portions, said handle portions being disposed on a first side of said overlapped central portions and said jaw portions being disposed on a second side of said overlapped central portions opposite said first side, said lever arms being pivotable such that said jaw portions move relatively toward and away from each other in response to relative movement of said handle portions respectively toward and away from each other, each said jaw portion having a free end spaced from said overlapped central portions, first and second gripping plates each fixedly and nonmovably attached to respective said free ends of said first and second jaw portions, said first and second gripping plates including first and second gripping surfaces, at least one of said first gripping plate and said first jaw portion having means defining a substantially flat support surface facing oppositely from said first gripping surface and adapted for engagement against the work table, said gripping plates being arranged on said jaw portions such that said gripping surfaces face each other, said gripping plates being relatively movable toward and away from each other along with said jaw portions, said first gripping plate extending away from said first jaw portion at a first fixed angle relative thereto such that, when said gripping plates are separated by a first predetermined distance, said second handle portion is offset from said support surface toward said second gripping plate by a second predetermined distance, said second gripping plate extending away from said second jaw portion at a second fixed angle relative thereto such that said gripping plates are substantially parallel to each other when they are separated by said first predetermined distance.

13. In combination, a grinding apparatus for grinding a decorative glass plate, and a hand-held tool for holding the decorative glass plate, said grinding apparatus including means defining a substantially planar work surface, means defining an abrasive grinding surface, and support means, for supporting said grinding surface in a plane oriented transversely to said planar work surface, said tool including a member having means defining a flat engagement surface for seating flush against said planar work surface, said member also including means defining a gripping surface facing generally oppositely of said flat engagement surface for supporting the glass plate, said tool also including hand-operated means for facilitating a manually powered releasable clamping of the glass plate on said gripping surface without the hand breaking a plane defined by said flat engagement surface, whereby, when said flat engagement surface is seated flush against said planar work surface, the glass plate is securely supported for continuous engagement against said grinding surface without contact between the hand and said planar work surface.

14. The combination according to claim 13, wherein said gripping surface is spaced from and approximately parallel to said flat engagement surface for facilitating support of the glass plate approximately parallel to but spaced from said planar work surface when said flat engagement surface is seated thereon.

* * * * *

UNITED STATES PATENT AND TRADEMARK OFFICE

CERTIFICATE OF CORRECTION

PATENT NO. : 4,961,291

DATED : October 9, 1990

INVENTOR(S) : Richard L. Lagassee

It is certified that error appears in the above-identified patent and that said Letters Patent is hereby corrected as shown below:

Column 5, line 21; after "plates" insert
---being arranged on said jaw portions such
that said gripping---.

Column 7, line 8; delete ",".

Signed and Sealed this

Thirtieth Day of June, 1992

*Attest:*

DOUGLAS B. COMER

*Attesting Officer*

*Acting Commissioner of Patents and Trademarks*